US010765178B2

(12) United States Patent
Takani

(10) Patent No.: US 10,765,178 B2
(45) Date of Patent: Sep. 8, 2020

(54) ELEMENT, FASTENER STRINGER, AND SLIDE FASTENER

(71) Applicant: YKK Corporation, Tokyo (JP)

(72) Inventor: Go Takani, Shenzhen Guangdong (CN)

(73) Assignee: YKK Corporation (JP)

( * ) Notice: Subject to any disclaimer, the term of this patent is extended or adjusted under 35 U.S.C. 154(b) by 0 days.

(21) Appl. No.: 16/327,360

(22) PCT Filed: Mar. 16, 2017

(86) PCT No.: PCT/CN2017/076931
§ 371 (c)(1),
(2) Date: Feb. 22, 2019

(87) PCT Pub. No.: WO2018/036140
PCT Pub. Date: Mar. 1, 2018

(65) Prior Publication Data

US 2019/0216183 A1 Jul. 18, 2019

(30) Foreign Application Priority Data

Aug. 23, 2016 (CN) ..... 2016 1 0702610

(51) Int. Cl.
*A44B 19/04* (2006.01)
*A44B 19/34* (2006.01)
(Continued)

(52) U.S. Cl.
CPC ..... *A44B 19/30* (2013.01); *A44B 19/24* (2013.01); *A44B 19/34* (2013.01); *Y10T 24/2539* (2015.01); *Y10T 24/2557* (2015.01)

(58) Field of Classification Search
CPC ... A44B 19/06; A44B 19/403; Y10T 24/2557; Y10T 24/2559; Y10T 24/2539
See application file for complete search history.

(56) References Cited

U.S. PATENT DOCUMENTS

2013/0133161 A1* 5/2013 Ren ..... A44B 19/303 24/434
2014/0068898 A1* 3/2014 Zagaglia ..... B21D 53/52 24/381
(Continued)

FOREIGN PATENT DOCUMENTS

CN 102934868 A 2/2013
CN 103027447 A 4/2013
(Continued)

OTHER PUBLICATIONS

International Preliminary Report on Patentability, PCT Patent Application No. PCT/CN2017/076931, dated Feb. 26, 2019.
(Continued)

*Primary Examiner* — Robert Sandy
*Assistant Examiner* — Michael S Lee
(74) *Attorney, Agent, or Firm* — Kilpatrick Townsend & Stockton LLP

(57) ABSTRACT

An element is configured to be installed together with a tape to form a fastener stringer, and includes: a main body including an upper main body and a lower main body; an installing portion for installing the tape; a head; and a neck connecting the main body and the head, wherein at least one of the upper main body and the lower main body includes a convex portion and a base portion, the convex portion protrudes from the base portion and extends in the left-right direction at an intermediate position in the front-rear direction. An inclined portion inclined downward along the left-right direction is formed on at least one side of the head along the upper-lower direction, and protrusions extending in the front-rear direction are formed on both sides of the convex portion.

8 Claims, 7 Drawing Sheets

(51) Int. Cl.
*A44B 19/30* (2006.01)
*A44B 19/24* (2006.01)

(56) References Cited

U.S. PATENT DOCUMENTS

| | | | | |
|---|---|---|---|---|
| 2014/0331460 | A1* | 11/2014 | Yamagishi ..... | A44B 19/306 24/418 |
| 2015/0033512 | A1 | 2/2015 | Kojima et al. | |
| 2016/0338453 | A1 | 11/2016 | Kojima | |
| 2017/0280832 | A1 | 10/2017 | Kojima et al. | |

FOREIGN PATENT DOCUMENTS

| | | | |
|---|---|---|---|
| CN | 103220929 | A | 7/2013 |
| WO | 2015-122018 | A1 | 8/2015 |
| WO | 2016-046915 | A1 | 3/2016 |

OTHER PUBLICATIONS

International Search Report, PCT Patent Application No. PCT/CN2017/076931, dated Jun. 13, 2017.
Written Opinion, PCT Patent Application No. PCT/CN2017/076931, dated Jun. 13, 2017.

* cited by examiner

ELEMENT, FASTENER STRINGER, AND SLIDE FASTENER

TECHNICAL FIELD

The present invention relates to an element, and a fastener stringer and a slide fastener manufactured by using the element.

BACKGROUND ART

Slide fasteners are widely applied to various clothing. A resin slide fastener has an advantage of reduced weight as compared to a metal slide fastener, and thus is widely applied in cases where weight reduction is required.

FIG. 1 is a schematic view showing an entire conventional slide fastener, and shows a conventional slide fastener 100 including a tape 10, elements 20, and a slider 30. The tape 10 and the elements 20 are installed together to form a fastener stringer. FIGS. 2(*a*) to 2(*d*) show the elements 20 in the conventional slide fastener viewed from four different angles, in which FIG. 2(*a*) is a perspective view, FIG. 2(*b*) is a front view, FIG. 2(*c*) is a top view, and FIG. 2(*d*) is a right side view. Each of the elements 20 include a main body 201, an installing portion 202, a neck 203, and a head 204. The main body 201 includes an upper main body 2011 and a lower main body 2012, and the upper main body 2011 and the lower main body 2012 are substantially rectangular when viewed from one side. The installing portion 202 is used for installing the tape 10 of the slide fastener 100, and the neck 203 is used for connecting the main body 201 and the head 204.

Currently, there is occasionally a need of further weight reduction of a resin slide fastener, which requires improvement of conventional elements by using lighter materials or optimizing and improving the structure of the elements. When improving the structure of the elements, it is necessary to guarantee both installation strength of the elements and smoothness and reliability in use of the slide fastener. Accordingly, there remains various demands on conventional slide fasteners, such as further weight reduction and guarantee of strength and smoothness in use.

SUMMARY OF INVENTION

Technical Problem

The invention has been made on the basis of the above problems, and provides an element that has an improved structure as compared to conventional elements, and is capable of achieving weight reduction and guaranteeing strength and reliability in use. The invention further provides a fastener stringer and a slide fastener manufactured by using the above-described element.

Solution to Problem

The element of the invention is an element configured to be installed together with a tape to form a fastener stringer, the element comprising:

a main body including an upper main body and a lower main body;

an installing portion for installing the tape;

a head; and a neck connecting the main body and the head, wherein, when a front-rear direction of the element is defined by a longitudinal direction of the fastener stringer, a left-right direction of the element is defined by a width direction of the fastener stringer, and an upper-lower direction of the element is defined by a thickness direction of the fastener stringer, at least one of the upper main body and the lower main body includes a convex portion and a base portion, and the convex portion protrudes from the base portion and extends in the left-right direction at an intermediate position in the front-rear direction.

According to the element of the invention, by providing the convex portion, the material of the element can be reduced to save the cost, and the weight of the element can be reduced to satisfy a demand for weight reduction.

Further, a dimension of the convex portion that occupies the base portion in the front-rear direction is 30% to 40% of a dimension of the base portion in the front-rear direction. According to this configuration, it is possible to achieve a good balance between weight reduction of the element and guarantee of overall strength of the element.

Further, the dimension of the convex portion that occupies the base portion in the front-rear direction is ⅓ of the dimension of the base portion in the front-rear direction. According to this configuration, it is possible to optimize the balance between weight reduction of the element and guarantee of overall strength of the element.

Further, in the element of the invention, an inclined portion inclined downward along the left-right direction is formed on at least one side of the head in the upper-lower direction. As a result, it is possible to further reduce the material to save the cost, thereby achieving an effect of further weight reduction.

Further, in the element of the invention, protrusions extending in the front-rear direction are formed on both sides of the convex portion. By providing the protrusions, it is possible to improve overall strength of the element so as to satisfy a demand for strength during use, while reducing the weight of the element.

Further, in the element of the invention, center lines of the protrusions coincide with a center line of the installing portion in the upper-lower direction. According to this configuration, it is possible to further optimize overall strength of the element.

Further, in the element of the invention, a height of the protrusions in the upper-lower direction is at least ½ of a height of the convex portion in the upper-lower direction. As a result, it is possible to achieve a better strengthening effect of the element while reducing the weight thereof.

In the element of the invention, a dimension of the protrusions in the left-right direction is no less than a dimension of the installing portion along the left-right direction. As a result, it is possible to further guarantee installation strength of the element.

The invention further provides a fastener stringer manufactured by using a plurality of the aforementioned element. According to the fastener stringer of the invention, it is possible to satisfy a demand for strength during use while achieving an effect of weight reduction.

The invention further provides a slide fastener assembled by a slider and the above-described fastener stringer, wherein the slider includes a pull tab and a stopping pawl, the pull tab can be raised and lowered, and when the pull tab is lowered, the stopping pawl is located between two of the elements.

According to the slide fastener of the invention, it is possible to ensure strength during use while achieving an effect of weight reduction. In addition, when the pull tab is lowered during use of the slide fastener, the stopping pawl is located between two of the elements, and the protrusion can prevent the stopping pawl from escaping between the two elements, so as to effectively stop the slider, thereby improving reliability in use of the slide fastener.

DESCRIPTION OF EMBODIMENTS

Figure 1:
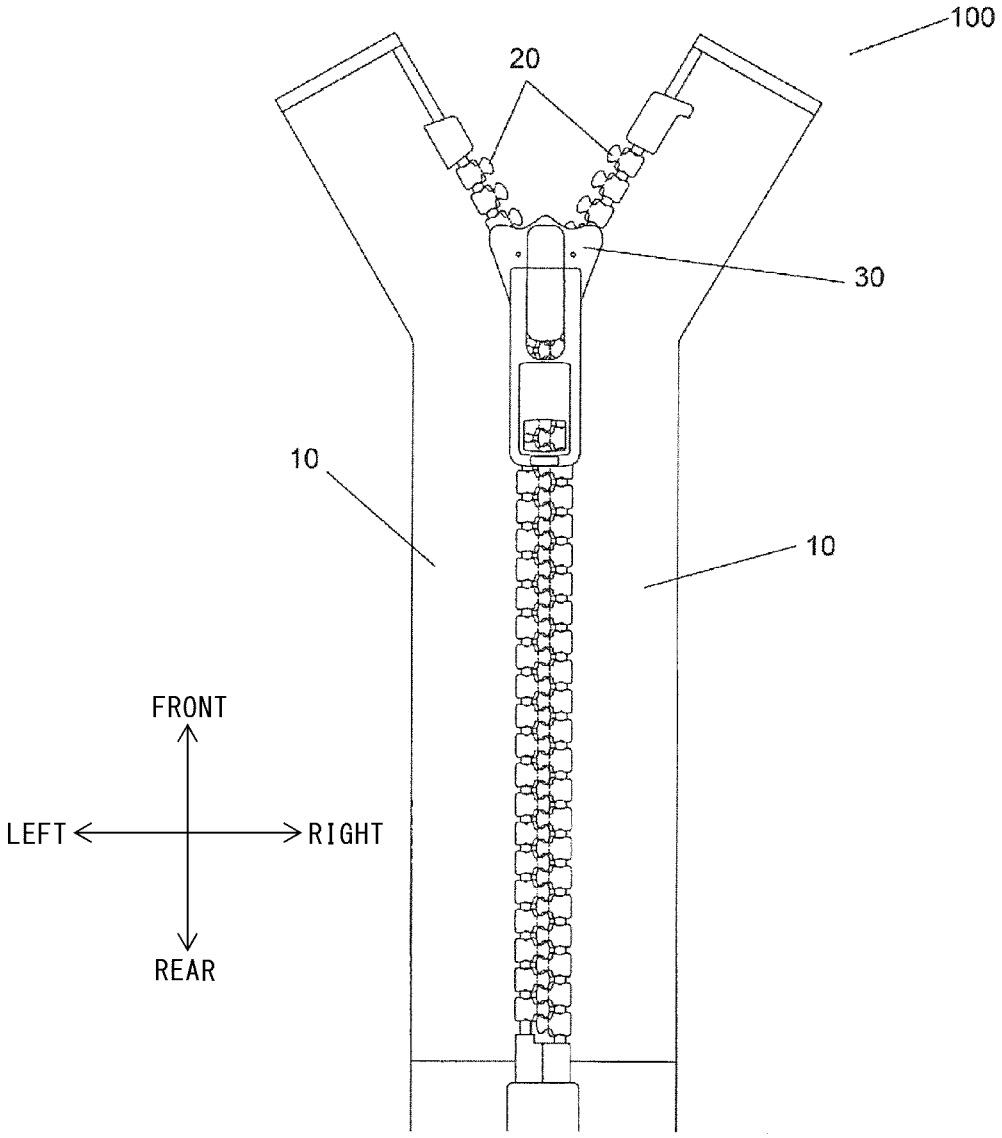
FIG. 1 is a schematic view showing an entire conventional slide fastener.
Figure 2A:
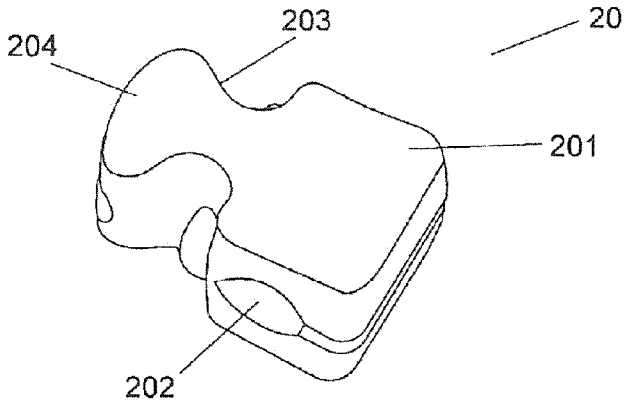
FIGS. 2(*a*) to 2(*d*) show a conventional element viewed from four different angles.
Figure 2B:
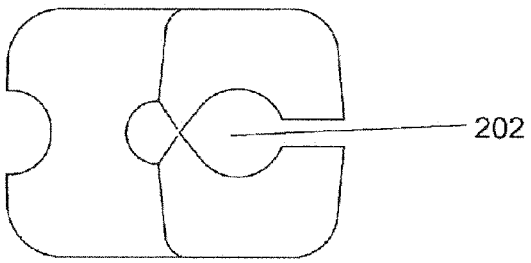
Figure 2C:
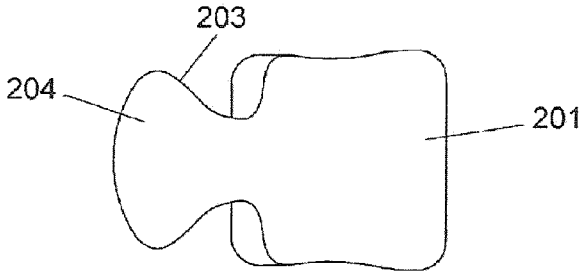
Figure 2D:
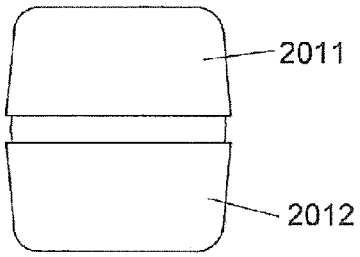
Figure 3A:
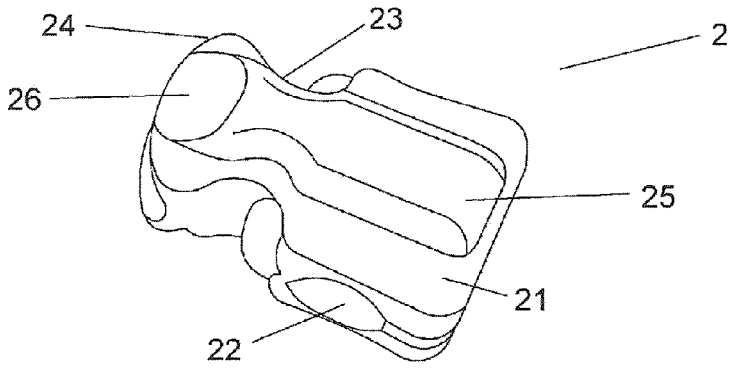
FIGS. 3(*a*) to 3(*d*) show an element according to Embodiment 1 of the invention viewed from four different angles.
Figure 3B:
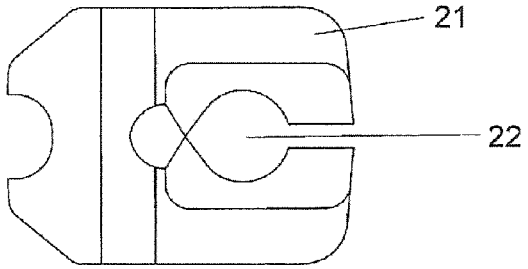
Figure 3C:
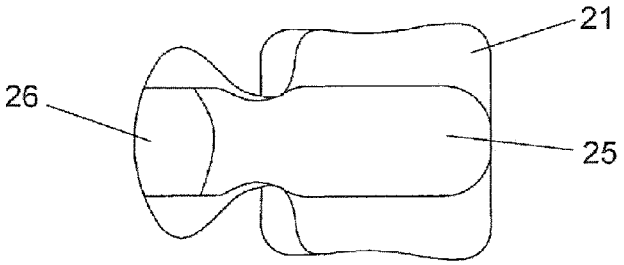
Figure 3D:
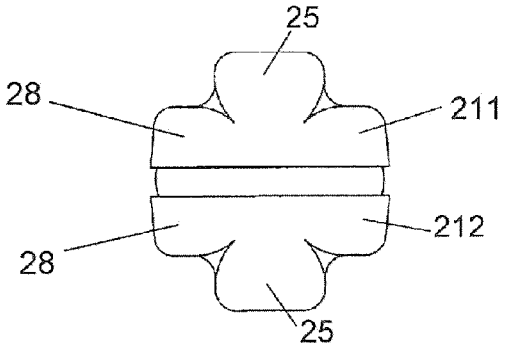
Figure 4A:
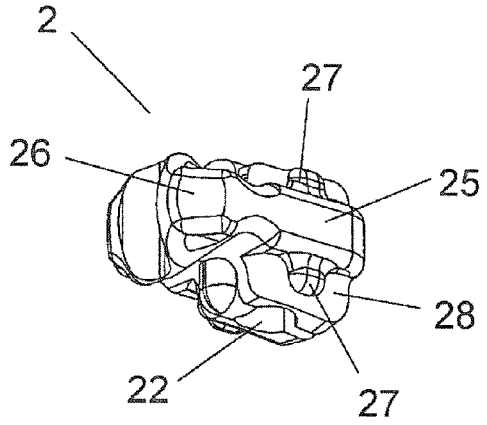
FIGS. 4(*a*) to 4(*e*) show an element according to Embodiment 2 of the invention viewed from five different angles.
Figure 4D:
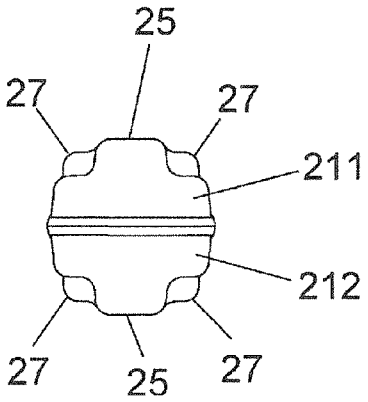
Figure 4B:
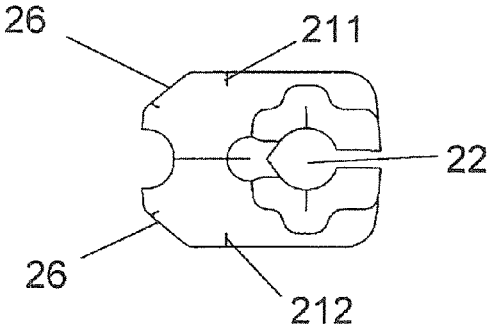
Figure 4E:
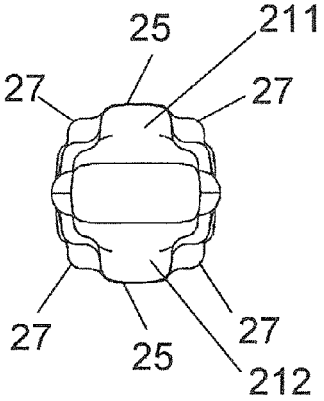
Figure 4C:
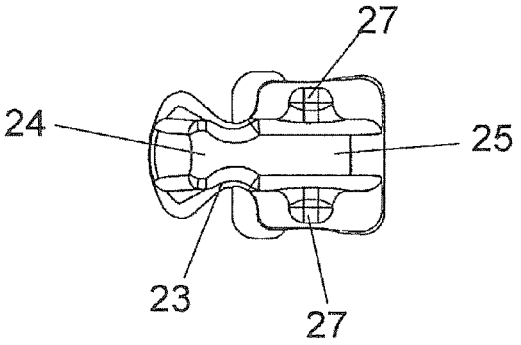

Hereinafter, the element, the fastener stringer, and the slide fastener of the invention will be described in detail with reference to the drawings. In the following description, the term "front-rear direction" refers to a direction that coincides with a longitudinal direction of the slide fastener or the fastener stringer, which is a direction that coincides with a movement direction of the slider. The term "left-right direction" refers to a direction that coincides with a width direction of the slide fastener or the fastener stringer, which is a direction orthogonal to the front-rear direction. The term "upper-lower direction" refers to a direction orthogonal to both the front-rear direction and the left-right direction, which is a direction that coincides with a thickness direction of the fastener stringer.

Embodiment 1

FIGS. 3(*a*) to 3(*d*) show an element according to Embodiment 1 of the invention viewed from four different angles, in which FIG. 3(*a*) is a perspective view, FIG. 3(*b*) is a front view, FIG. 3(*c*) is a top view, and FIG. 3(*d*) is a right side view. The element 2 of Embodiment 1 includes a main body 21, an installing portion 22, a neck 23, and a head 24. The main body 21 includes an upper main body 211 and a lower main body 212. The installing portion 22 is used for installing a tape of a slide fastener, and the neck 23 connects the main body 21 and the head 24.

At least one of the upper main body 211 and the lower main body 212 of the element 2 includes a convex portion 25 and a base portion 28. The convex portion 25 extends from the base portion 28, and extends in the left-right direction of the element 2 at an intermediate position in the front-rear direction of the element 2. With respect to the conventional element 20 of FIG. 2, by reducing the material in the front-rear direction with respect to at least one of the upper main body 2011 and the lower main body 2012, which are rectangular when viewed from the side, the convex portion 25 and the base portion 28 in FIG. 3 are formed so that the upper main body 211 and the lower main body 212 have a substantially T-shape when viewed from a side of the main body 21 (see FIG. 3(*d*)). The shape of the convex portion 25 is not particularly limited, and when viewed from the main body 21, the convex portion 25 may have various shapes such as a quadrangle (such as a rectangle or a square), a trapezoid, and a semicircle. Further, edges of the convex portion 25 may be chamfered into arcs. Preferably, a dimension of the convex portion 25 that occupies the base portion 28 in the front-rear direction is 30% to 40% of a dimension of the base portion 28 in the front-rear direction. More preferably, the dimension of the convex portion 25 that occupies the base portion 28 in the front-rear direction is ⅓ of the dimension of the base portion 28 in the front-rear direction. According to this configuration, it is possible to achieve a good balance between weight reduction of the element 2 and guarantee of overall strength of the element 2. Here, the "dimension of the convex portion 25 that occupies the base portion 28 in the front-rear direction" refers to a dimension of the convex portion 25 that occupies the base portion 28 in the front-rear direction when the upper main body 211 is viewed from above or when the lower main body 212 is viewed from below.

Further, with respect to the head 24 of the element 2, the material may be partially removed along the left-right direction in an inclined manner, so as to form an inclined portion 26 inclined downward. The inclined portion 26 is formed on at least one side of the element 2 in the upper-lower direction. Preferably, the element 2 have a vertically symmetrical shape, in which convex portions 25 and inclined portions 26 are respectively formed to correspond in a vertical direction.

As an example of methods for forming the convex portions 25, the material is partially removed from the upper main body 211 and the lower main body 212 while remaining an intermediate portion, so as to form the convex portions 25. As an example of methods for forming the element 2, the convex portion 25 and the inclined portion 26 may be formed by injection molding with a modified mold.

The tape of the slide fastener includes a tape main body and a core 11. The core 11 is formed on one side in the width direction of the tape main body, and has a substantially circular cross section. The core 11 is installed together with installing portions 22 of a plurality of the element 2 so as to form a fastener stringer, and two of the fastener stringer are engaged and assembled with each other by a slider, so as to form a slide fastener. The tape and the elements 2 may be assembled together, or alternatively, the elements 2 may be directly injection-molded on the tape.

According to the elements 2 of the present embodiment, it is possible to achieve an effect of weight reduction and satisfy a demand for weight reduction. According to the fastener stringer and the slide fastener manufactured by using the element 2 of the present embodiment it is also possible to achieve weight reduction.

Embodiment 2

FIGS. 4(*a*) to 4(*e*) show an element according to Embodiment 2 of the invention viewed from five different angles, in which FIG. 4(*a*) is a perspective view, FIG. 4(*b*) is a front view, FIG. 4(*c*) is a top view, FIG. 4(*d*) is a right side view, and FIG. 4(*e*) is a left side view. Hereinafter, differences from Embodiment 1 will be described in detail, and description of the same parts as those of Embodiment 1 will be omitted.

Similarly as Embodiment 1, the element 2 of Embodiment 2 also has the convex portions 25 and the inclined portions 26. The element 2 of Embodiment 2 is further provided with protrusions 27 as compared to Embodiment 1. Preferably, protrusions 27 are formed symmetrically on both sides of the convex portions 25 along the front-rear direction of the element 2. More preferably, center lines of the protrusions 27 coincide with a center line of the installing portion 22 of the element 2 in the upper-lower direction. That is, the protrusions 27 are positioned directly above and below the installing portion 22. It has been proved by parameter measurement and experiment that according to the above configuration, it is possible to improve strength of the element 2, and to improve overall strength after formation of the fastener stringer.

Although the convex portions 25 and the protrusions 27 are respectively formed on both the upper main body 211 and the lower main body 212 of the element 2 as shown in FIG. 4(*e*), the convex portion 25 and the protrusions 27 may be formed on only one of the upper main body 211 and the lower main body 212. In the present embodiment, by providing the protrusions 27, it is possible to improve overall strength of the element 2 and to improve overall strength after the fastener stringer is formed, while reducing the weight of the elements 2.

Figure 5:
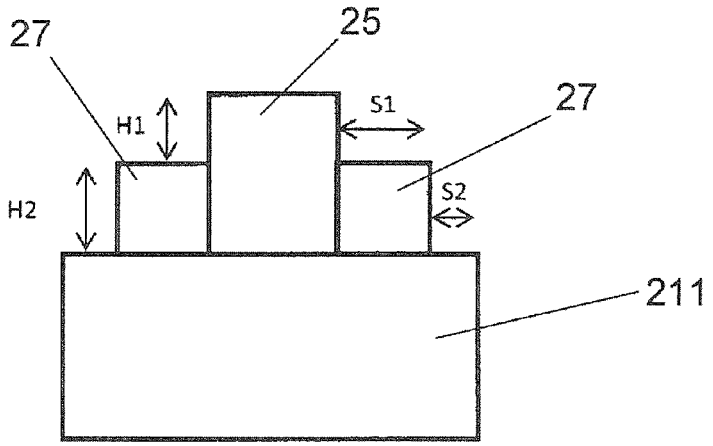
FIG. 5 is a partial schematic view of the element of Embodiment 2 of the invention.
Figure 6:
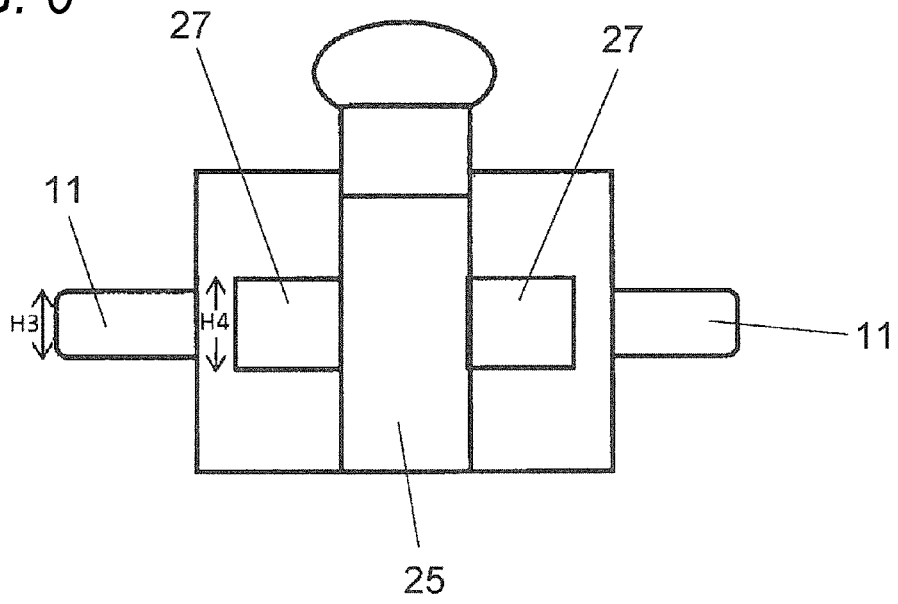
FIG. 6 is a partial schematic view showing the relationship between the element and the core of Embodiment 2 of the invention.

Hereinafter, the relationship of each part of the element 2 of Embodiment 2 will be described by referring to FIGS. 5 and 6. FIG. 5 is a partial (the upper main body 211) schematic view of the elements 2. FIG. 6 is a partial schematic view showing the relationship of the elements 2 and the core 11, and is a schematic top view of the element 2. In FIG. 5, a height of the protrusions 27 in the upper-lower direction is H2, a height of the convex portions 25 in the upper-lower direction is H1+H2, a dimension of the protrusions 27 extending from the convex portions 25 in the front-rear direction is S1, and a distance from the protrusions 27 to an edge of the upper main body 211 is S2. A dimension of S2 satisfies $S2 \geq 0$. In order to further optimize strength of the element 2, H1 and H2 satisfy the following relationship: $H2/(H1+H2) \geq 50\%$. That is, the height of the protrusions 27 in the upper-lower direction is at least ½ of the height of the convex portions 25 in the upper-lower direction.

In FIG. 6, the core 11 is installed together with installing portions 22 of the elements 2. A dimension of the core 11 in the left-right direction is H3, and a dimension of the protrusions 27 in the left-right direction is H4. Preferably, the following relationship is satisfied: $H4 \geq H3$. That is, the dimension H4 of the protrusions 27 in the left-right direction is preferably no less than the dimension of the installing portions 22 in the left-right direction. It has been proved by parameter measurement and experiment that the above-described dimensional relationship can further optimize strength of the element 2.

Figure 7:
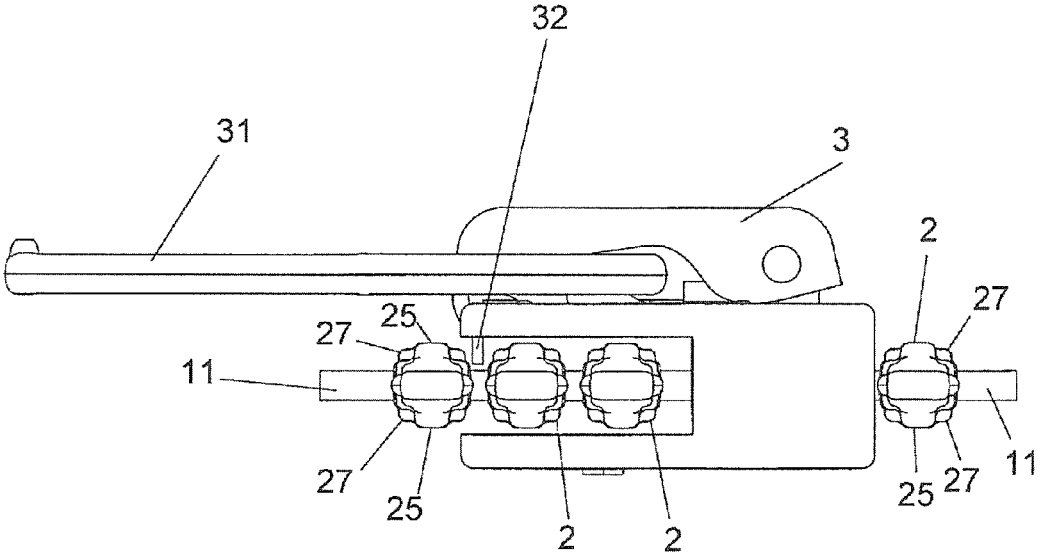
FIG. 7 is a schematic view showing the relationship between a slider and a fastener stringer of Embodiment 2 of the invention.
Figure 8:
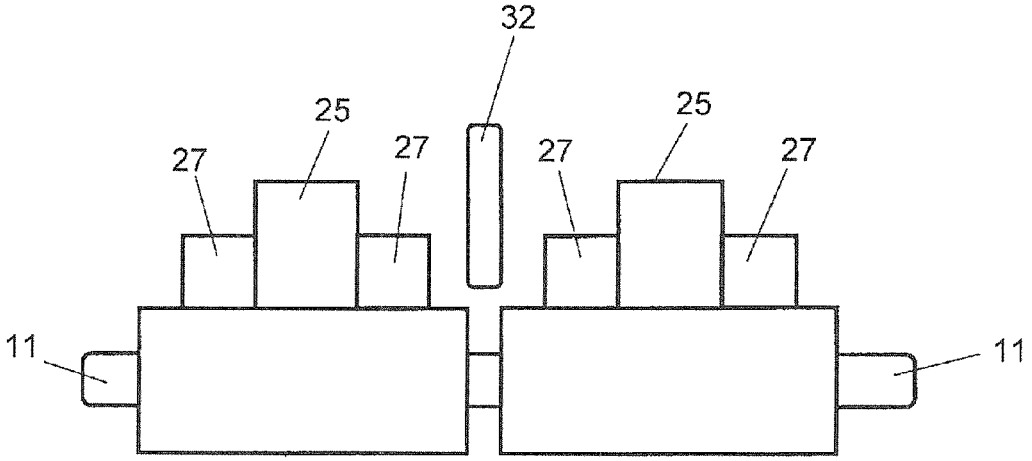
FIG. 8 is a partial schematic view showing the relationship between a stopping pawl and a fastener stringer of Embodiment 2 of the invention.

FIG. 7 is a schematic view showing the relationship between a slider 3 and the fastener stringer of Embodiment 2 of the invention. The slider 3 includes a slider main body, a pull tab 31, a stopping pawl 32, and a slider cover. The slider main body includes an upper blade, a lower blade, and a column connecting the upper blade and the lower blade. A space for the fastener stringer to pass through is formed between the upper blade and the lower blade. FIG. 7 shows a state in which the pull tab 31 is lowered. At this time, the stopping pawl 32 is located between two of the elements 2 on the fastener stringer. The stopping pawl 32 is blocked by the protrusions 27, and stops the slide fastener from being opened when the slider 3 is unconsciously moved. When the pull tab 31 is raised, the stopping pawl 32 is separated from between the two elements 2, and the pull tab 3 can be pulled up and down. FIG. 8 is a partial schematic view showing the relationship between the stopping pawl 32 and the fastener stringer, and shows a state in which the stopping pawl 32 is positioned between the protrusions 27 of the two elements 2. The protrusions 27 can effectively stop movement of the stopping pawl 32 in the front-rear direction, and prevents the stopping pawl 32 from escaping between the two elements 2 and becoming incapable of stopping the slider 3.

In Embodiment 2, by providing the protrusions 27 on both sides of the convex portion 25, the following advantageous effects can be achieved. That is, it is possible to improve strength of the element 2, and to thereby improve strength of the fastener stringer and the slide fastener manufactured by using the element 2, while maintaining a reduced weight of the element 2. In addition, when the pull tab 31 is lowered, it is possible to prevent the stopping pawl 32 from escaping between the two elements 2, and to effectively stop the slider 3, thereby ensuring reliability in use of the slide fastener.

While the element, the fastener stringer, and the slide fastener of the invention has been described above, the invention is not limited to the embodiments described above, and various modifications can be made by those skilled in the art based on the disclosure of the invention. These modifications are included in the scope of the invention. For example, the element of the invention is not limited to resin elements, and the structure of the invention can also be used to elements made of metal or the like.

REFERENCE SIGN LIST

100 Slide fastener
10 Tape
11 Core
20, 2 Element
30, 3 Slider
201, 21 Main body
2011, 211 Upper main body
2012, 212 Lower main body
202, 22 Installing portion
203, 23 Neck
204, 24 Head
25 Convex portion
26 Inclined portion
27 Protrusion
28 Base portion
31 Pull tab
32 Stopping pawl

The invention claimed is:

1. An element configured to be installed together with a tape to form a fastener stringer, the element comprising:

a main body including an upper main body and a lower main body;

an installing portion for installing the tape;

a head; and a neck connecting the main body and the head, wherein, when a front-rear direction of the element is defined by a longitudinal direction of the fastener stringer, a left-right direction of the element is defined by a width direction of the fastener stringer, and an upper-lower direction of the element is defined by a thickness direction of the fastener stringer, at least one of the upper main body and the lower main body includes a convex portion and a base portion, and the convex portion protrudes from the base portion and extends in the left-right direction at an intermediate position in the front-rear direction, wherein protrusions extending in the front-rear direction are formed on both sides of the convex portion, and wherein center lines of the protrusions along the front-rear direction coincide with a center line of the installing portion along the front-rear direction, in the upper-lower direction.

2. The element according to claim 1, wherein a dimension of the convex portion that occupies the base portion in the front-rear direction is 30% to 40% of a dimension of the base portion in the front-rear direction.

3. The element according to claim 2, wherein the dimension of the convex portion that occupies the base portion in the front-rear direction is ⅓ of the dimension of the base portion in the front-rear direction.

4. The element according to claim 1, wherein an inclined portion inclined downward along the left-right direction is formed on at least one side of the head in the upper-lower direction.

5. The element according to claim 1, wherein a height of the protrusions in the upper-lower direction is at least ½ of a height of the convex portion in the upper-lower direction.

6. The element according to claim 1, wherein a dimension of the protrusions in the left-right direction is no less than a dimension of the installing portion along the left-right direction.

7. A fastener stringer manufactured by using a plurality of the elements according claim 1.

8. A slide fastener assembled by a slider and the fastener stringer according to claim 7, wherein the slider includes a pull tab and a stopping pawl, the pull tab can be raised and lowered, and when the pull tab is lowered, the stopping pawl is located between two of the elements.

* * * * *